US006904826B2

(12) United States Patent
Hesener

(10) Patent No.: US 6,904,826 B2
(45) Date of Patent: Jun. 14, 2005

(54) ARM BEARING FOR AN ARTICULATED-ARM AWNING

(75) Inventor: Karl Hesener, Finnentrop (DE)

(73) Assignee: Paul Voss GmbH & Co. KG, Finnentrop-Heggen (DE)

( * ) Notice: Subject to any disclaimer, the term of this patent is extended or adjusted under 35 U.S.C. 154(b) by 0 days.

(21) Appl. No.: 10/305,819

(22) Filed: Nov. 26, 2002

(65) Prior Publication Data

US 2003/0108259 A1 Jun. 12, 2003

Related U.S. Application Data

(63) Continuation of application No. 10/110,803, filed on Dec. 2, 2002, now abandoned, which is a continuation of application No. PCT/EP00/09621, filed on Sep. 30, 2000.

(30) Foreign Application Priority Data

Oct. 14, 1999 (DE) ..... 299 18 156 U

(51) Int. Cl.[7] ..... E04F 10/06

(52) U.S. Cl. ..... 74/483 R; 160/73; 160/79; 16/319; 16/366

(58) Field of Search ..... 74/483 R; 160/66, 160/67, 73, 22; 16/297, 302, 319, 366, 367, 368, 371, 236, 239, 249, 324, 325, 326, 327, 328, 329, 333, 343, 345, 348

(56) References Cited

U.S. PATENT DOCUMENTS

| | | | | |
|---|---|---|---|---|
| 1,871,957 A | * | 8/1932 | Chryst | 403/152 |
| 3,782,443 A | | 1/1974 | Clauss et al. | |
| 4,566,516 A | * | 1/1986 | Lohausen | 160/22 |
| 4,673,017 A | | 6/1987 | Lauzier | |
| 5,029,363 A | * | 7/1991 | Hesener | 16/241 |
| 5,133,397 A | | 7/1992 | Lohausen | |
| 5,394,921 A | | 3/1995 | Lohausen | |

FOREIGN PATENT DOCUMENTS

| | | |
|---|---|---|
| DE | G 87 09 415 | 11/1987 |
| DE | 89 07 928.0 | 6/1989 |
| DE | 196 18 460 A | 11/1997 |
| EP | 0 397 906 A | 11/1990 |
| EP | 0 593 389 A | 4/1994 |
| NL | 900 2439 A | 6/1992 |

* cited by examiner

*Primary Examiner*—William C. Joyce
(74) *Attorney, Agent, or Firm*—Knobbe, Martens, Olson & Bear, LLP

(57) ABSTRACT

An arm bearing for an articulated-arm awning having a pillow block hinged on a bracket. The pillow block is provided on one end with at least one bearing eye for receiving one awning arm in rotary fashion. A threaded rod limits the tilting angle between the bracket and the pillow block. A first end of the threaded rod being adjustably screwed into a locating opening in the bracket and a second end of the threaded rod being provided with a head that rests against a stop on the pillow block in a maximally tilted angular position. The arm bearing includes a locking member with which the threaded rod can be fixed on the stop. The locking member includes a locking slide that can be coupled with the awning arm via a connection element to induce rotary movement of the awning arm to disengage the locking slide.

30 Claims, 9 Drawing Sheets

ARM BEARING FOR AN ARTICULATED-ARM AWNING

CROSSREFERENCE TO PENDING APPLICATION

This application is a continuation of U.S. application Ser. No. 10/110,803 filed on Dec. 2, 2002, now abandoned which is a continuation national phase entry in the United States under 35 U.S.C. § 371 of pending international application PCT/EP00/09621 filed on Sep. 30, 2000 which designates the U.S. and which claims priority of German utility model No. 299 18 156.1 filed on Oct. 14, 1999.

BACKGROUND OF THE INVENTION

The present invention relates to an arm bearing for an articulated-arm awning having a pillow block, that is hinged on a bracket so as to tilt about a tilting axis and that is provided on one of its ends with at least one bearing eye for receiving one awning arm in rotary fashion, and having further a threaded rod for limiting the maximum tilting angle between the bracket and the pillow block, a first end of the threaded rod being adjustably screwed into a locating opening in the bracket and a second end of the threaded rod being provided with a head that rests against a stop on the pillow block in the maximally tilted position, and having finally a locking member by means of which the head of the threaded rod can be fixed on the stop in the maximally tilted angular position.

An arm bearing of this kind is known from German Utility Patent No. G 87 09 415 U1.

In the case of the known arm bearing, also known as tilting joint because of the pivoting connection between the pillow block and the bracket, the locking member consists of an angle element which has one of its ends connected to the rotatable end of the awning arm, while its other end projects freely. The arrangement is sized so that any rotation of the awning arm will cause the second leg of the angle element to be rotated over the head of the threaded rod whereby the latter is fixed on the stop of the pillow block. One thereby implements an upthrust protection which prevents the tilted pillow block from returning inadvertently into a non-tilted position. This might otherwise happen, for example, when the awning is fully extended and when a gust of wind hits against the awning fabric from below.

The design of the known arm bearing is comparatively simple. It does not, however, provide the possibility to decouple the fixed condition of the threaded rod from the rotary position of the awning arm if this should become necessary. It is for this reason that the known arm bearing as such cannot be used as a rigid arm bearing with adjustable tilting angle.

EP 0 397 906 A1 likewise discloses an arm bearing for an articulated-arm awning where the pillow block and the bracket are arranged to be pivoted about a tilting axis one relative to the other. The upthrust protection is again constituted by a locking member, configured in this case as a linearly movable locking slide. In view to the problem underlying that publication, that slide is independent of a stop, which may be additionally provided, and is easy to produce. An alternative use of that tilting-joint arm bearing as a rigid arm bearing with adjustable tilting angle is, however, not envisaged.

It is the object of the present invention to improve an arm bearing of the before-mentioned kind so that it can be used easily as either a tilting-joint arm bearing or a rigid arm bearing with adjustable tilting angle.

SUMMARY OF THE INVENTION

This object is achieved, in the case of the arm bearing described at the outset, by the fact that the locking member comprises a linearly movable locking slide that can be coupled with the awning arm via a connection element, which latter translates the rotary movement of the awning arm to a linear movement of the locking slide.

The present arm bearing distinguishes itself from the known arm bearings in that a connection element is provided which when eliminated or removed results in the locking slide being decoupled from the movement of the awning arm. This in turn has the result that the locking slide is capable of fixing the head of the threaded rod on the stop, irrespective of the rotary position of the awning arm, so that the awning arm will retain the tilting angle once adjusted, irrespective of the position of the awning arm. This is the function of a rigid awning arm whose tilting angle can be adjusted with the aid of the threaded rod.

In contrast, when the connection element is used, then the rotary position of the awning arm will influence the linear position of the locking slide. This then results in the locking slide releasing the tilting joint between the pillow block and the bracket, as a function of the angular position of the awning arm, so that the pillow block can be turned up. The arrangement then acts as a tilting-joint arm bearing in that operating mode.

From the above it results that the arm bearing according to the invention can be converted from a tilting-joint arm bearing to a rigid arm bearing and vice versa simply by the optional use of the connection element. As will be apparent from the embodiments that will be described hereafter, the possibility to use the connection element optionally can be implemented in a very simple way, in technical and constructional terms. Consequently, the arm bearing according to the invention can be optionally used as a tilting-joint arm bearing or a rigid arm bearing with the same ease.

The object underlying the present invention is thus perfectly achieved.

The arm bearing according to the invention offers a number of additional advantages, especially when employed in the preferred embodiments defined in the dependent claims. Specifically, the production costs of the arm bearing according to the invention can be kept low due to the fact that the dual use now permits the production numbers to be increased considerably. Further, it is now possible due to the measure according to the invention to convert such an arm bearing to the respective alternative use even after several years of operation. And in addition, the preferred embodiments of the arm bearing according to the invention also have very small overall dimensions and are particularly simple and robust.

It is understood that the features recited above and those yet to be explained below can be used not only in the respective combination indicated, but also in other combinations or in isolation, without leaving the context of the present invention.

BRIEF DESCRIPTION OF THE DRAWINGS

Exemplary embodiments of the invention are shown in the drawings and are explained in more detail in the description which follows. In the drawings.

DETAILED DESCRIPTION OF PREFERRED EMBODIMENTS

Figure 1:
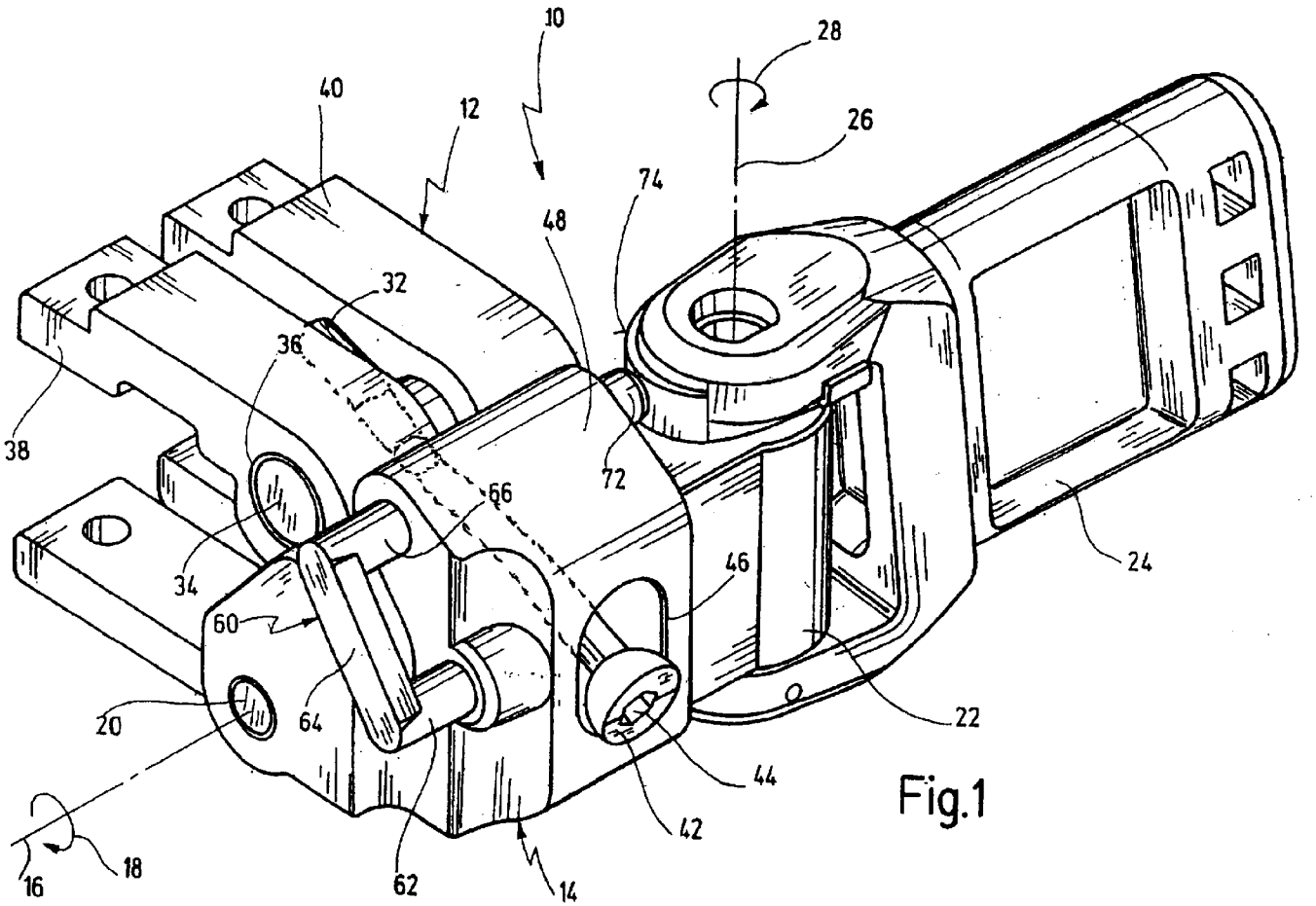
FIG. 1 shows a perspective representation of an arm bearing according to the invention used as tilting-joint arm bearing.
Figure 2:
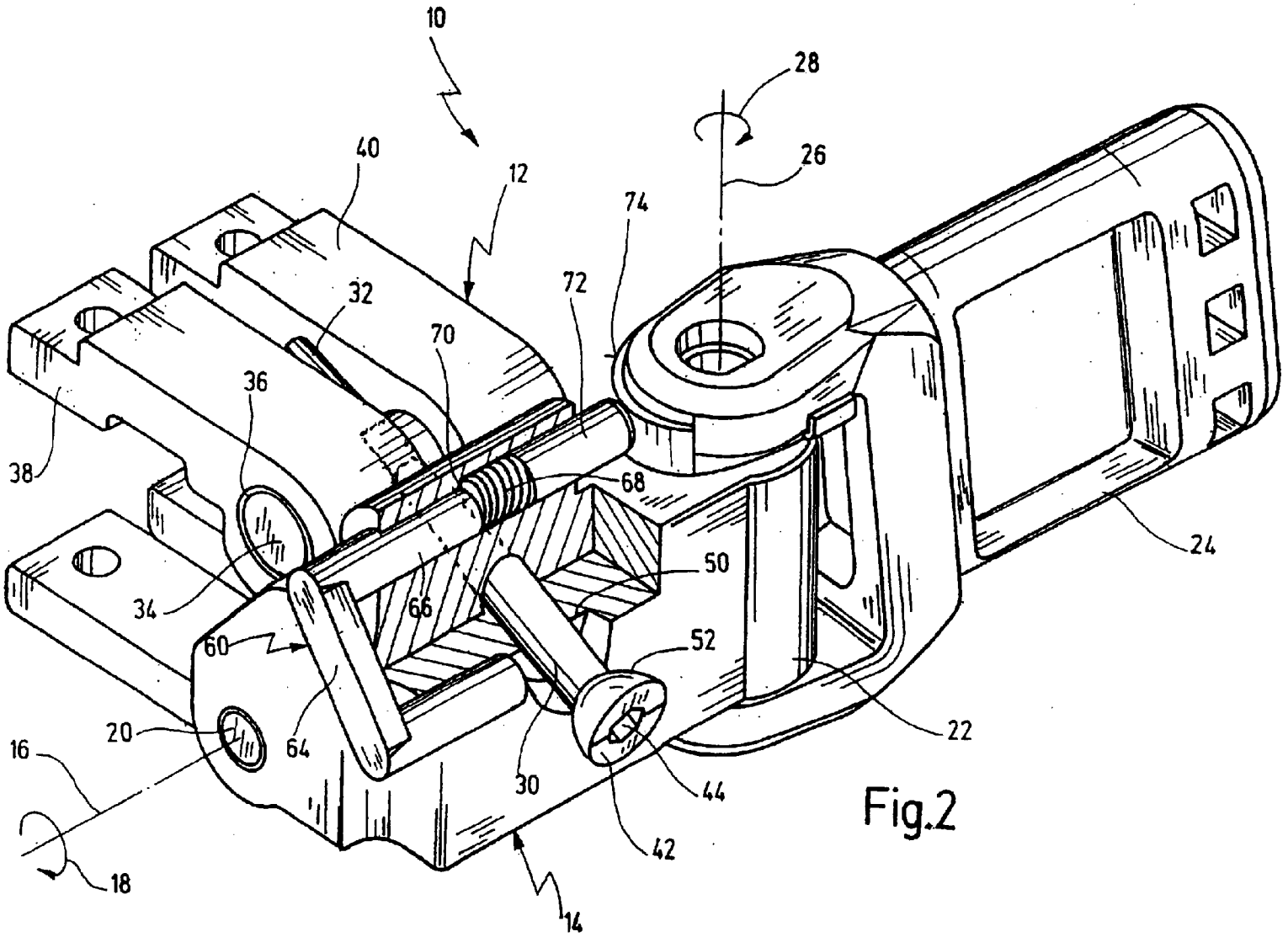
FIG. 2 shows the arm bearing of FIG. 1, with part of the pillow block removed in order to demonstrate the function of the locking member.

In FIGS. 1 and 2, an arm bearing according to the invention is designated in its entirety by reference numeral 10.

The arm bearing 10 comprises a bracket 12 with a pillow block 14 arranged thereon to pivot about the tilting axis 16 in a direction indicated by arrow 18. The bracket 12 and the pillow block 14 comprise for this purpose bores that are aligned one with the other and through which a bolt 20 is passed in the direction of the tilting axis 16.

The end of the pillow block 14 is provided with a bearing eye 22 on which is rotatably seated a link rod 24 of an awning arm nor shown in detail. The awning arm consists, in the conventional way, of a hollow aluminium section fitted on the link rod 24. The link rod 24 is thereby connected with the awning arm so intimately that the terms "link rod" and "awning arm" will be used hereafter as synonyms for the sake of simplicity.

The awning arm 24 is seated in the bearing eye 22 for rotation about a rotary axis 26 in the direction indicated by arrow 28. That rotary movement takes place when the awning is extended.

Reference numeral 30 designates a threaded rod which, in the present case, extends crosswise to the tilting axis 16, from the pillow block 14 to the bracket 12. The first end 32 of the threaded rod 30 is screwed into a transverse bore in a bolt 34 with a corresponding internal thread, not visible in this representation. The bolt 34 thus forms a seat for the threaded rod 30.

Additionally, the threaded rod 30 is fixed in its respective instantaneous position by a spring element not shown in the drawing, which urges a pin laterally into the thread of the threaded rod 30. This arrangement works as a protection against torsion. Alternatively, the latter may, however, be implemented also in the conventional way, using a grub screw.

The bolt 34 is received in mutually aligned bores 36 arranged in parallel to the tilting axis 16, but above the latter, in mutually parallel legs 38, 40 of the bracket 12. The threaded rod 30 therefore has its first end 32 extending between the two legs 38, 40 of the two-piece bracket 12.

The second end of the threaded rod 30 carries a head 42 with a hexagon socket 44 provided in its end face. The hexagon socket 44 is capable of receiving a hexagon wrench by means of which the threaded rod 30 can be threaded a greater or lesser length into the bolt 34.

As can be seen in FIG. 1, the pillow block 14 is provided with a substantially oval passage opening 46 through which the head 42 of the threaded rod 30 can be passed. In FIG. 2, the housing element 48 comprising the passage opening 46 has been removed to reveal the "insides" of the pillow block 14. In practice it is, however, not possible to remove the housing element 48 of the arm bearing 10.

As can be seen in the representation of FIG. 2, the pillow block 14 is provided in its interior with a stop 50 which, in conjunction with the head 42 of the threaded rod 30, acts to limit the maximum tilting angle $\alpha$ of the pillow block 14 in the direction indicated by arrow 18. The tilted condition of the arm bearing 10 is illustrated in FIGS. 3 and 4; from FIG. 4 it is apparent that the rear end 52 of the head 42 comes to rest against the stop 50 when the maximum tilting angle $\alpha$ is reached.

Figure 3:
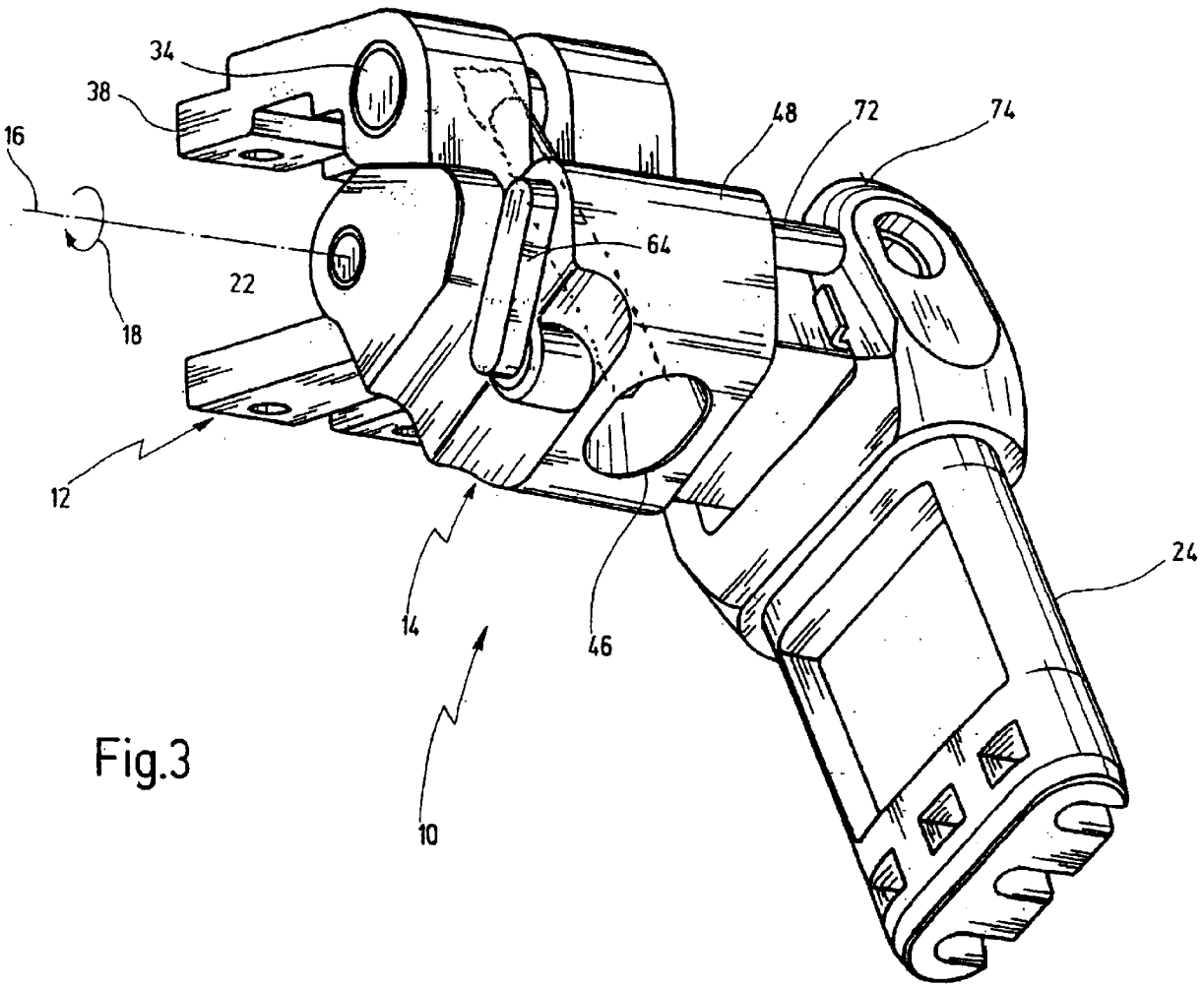
FIG. 3 shows the arm bearing according to FIG. 1 in a tilted position.
Figure 4:
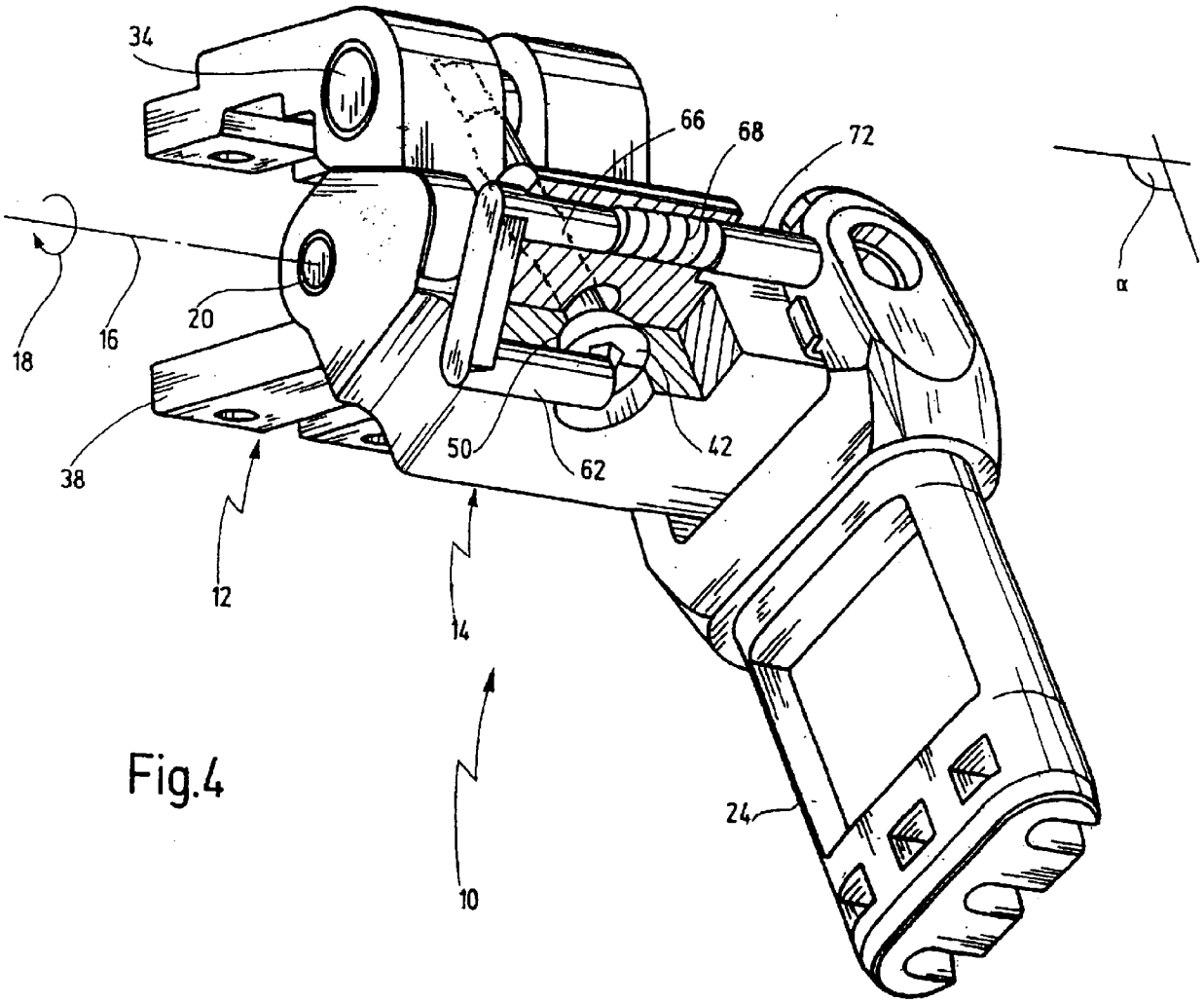
FIG. 4 shows the arm bearing of FIG. 3, again with part of the pillow block removed.

Reference numeral 60 designates a locking member assembly which acts to fix the head 42 of the arm bearing 30 on the stop 50 in the tilted position of the awning arm 10 illustrated in FIGS. 3 and 4. It is thus prevented that the rear end 52 of the head 42 may come free of its contact with the stop 50 which would mean that the pillow block 14 would swing up abruptly against the direction indicated by arrow 18. The locking member 60 therefore constitutes an upthrust protection.

In the present case, the locking member 60 comprises a locking slide 60 that can be moved linearly in a bore in the pillow block 14, in parallel to the tilting axis 16. The locking slide 62 is formed in the present case by a solid circular bolt made from stainless steel. It is connected via a cross-member 64 with a push rod 66 that extends in the pillow block 14, likewise in parallel to the tilting axis 16. The push rod 66 is biased by a spring 68 bearing against a projection 70 in the pillow block 14. The free end 72 of the push rod 66 projects from the housing element 48 of the pillow block 14 and rests against an eccentric, in the present case cam-shaped, outer contour 74 of the link rod 24.

In the case of the illustrated arm bearing, the locking slide 62 and the push rod 66 form a single piece, connected via the cross-member 64. In a different embodiment not shown in the drawings, the locking slide 62 may alternatively be connected with the cross-member 64 in detachable fashion so that the connection element can be removed without any necessity to exchange the locking slide 62.

FIGS. 1 and 2 show the locking member 60 in its unlocked position in which the head 42 of the threaded rod 30 can pass through the passage opening 46 of the pillow block 14. The pillow block 14 is tilted up against the bracket 12.

In contrast, in the representations of FIGS. 3 and 4 the pillow block 14 is tilted down in the direction of arrow 18, and the head 42 of the threaded rod 30 is secured by the locking member 60. The locking slide 62 therefore occupies a locking position in which it engages the hexagon socket of the head 42 laterally only to such an extent that the threaded rod 30 can be adjusted even in the locked position.

As appears from the representation of FIGS. 1 to 4, locking and unlocking of the threaded rod 30 is achieved by displacing the locking slide 62 linearly in parallel to the tilting axis 16. This is effected with the aid of the push rod 66 whose linear position is determined by the cam-shaped outer contour 74 of the link rod 24. The force of the spring 68 tends to move the locking slide 62 into its locking position. Correspondingly, the spring 68 is in its relaxed state when the locking slide 62 occupies its locked position.

The push rod 66 and the cross-member 64 form together a connection element that establishes an operative connection between the locking slide 62 and the link rod 24 so that the angular position of the link rod 24 about the rotary axis 26 influences the linear position of the locking slide 62. In the absence of such operative connection, the locking slide 62 remains in its respective linear position, irrespective of the rotary position of the link rod 24.

This relationship has been utilized in the embodiment of the arm bearing, that will be described hereafter with reference to FIGS. 5 to 8, for realizing an arm bearing with adjustable tilting angle. Identical elements of these embodiments have been designated by the same reference numerals as in the previously described Figures.

Figure 5:
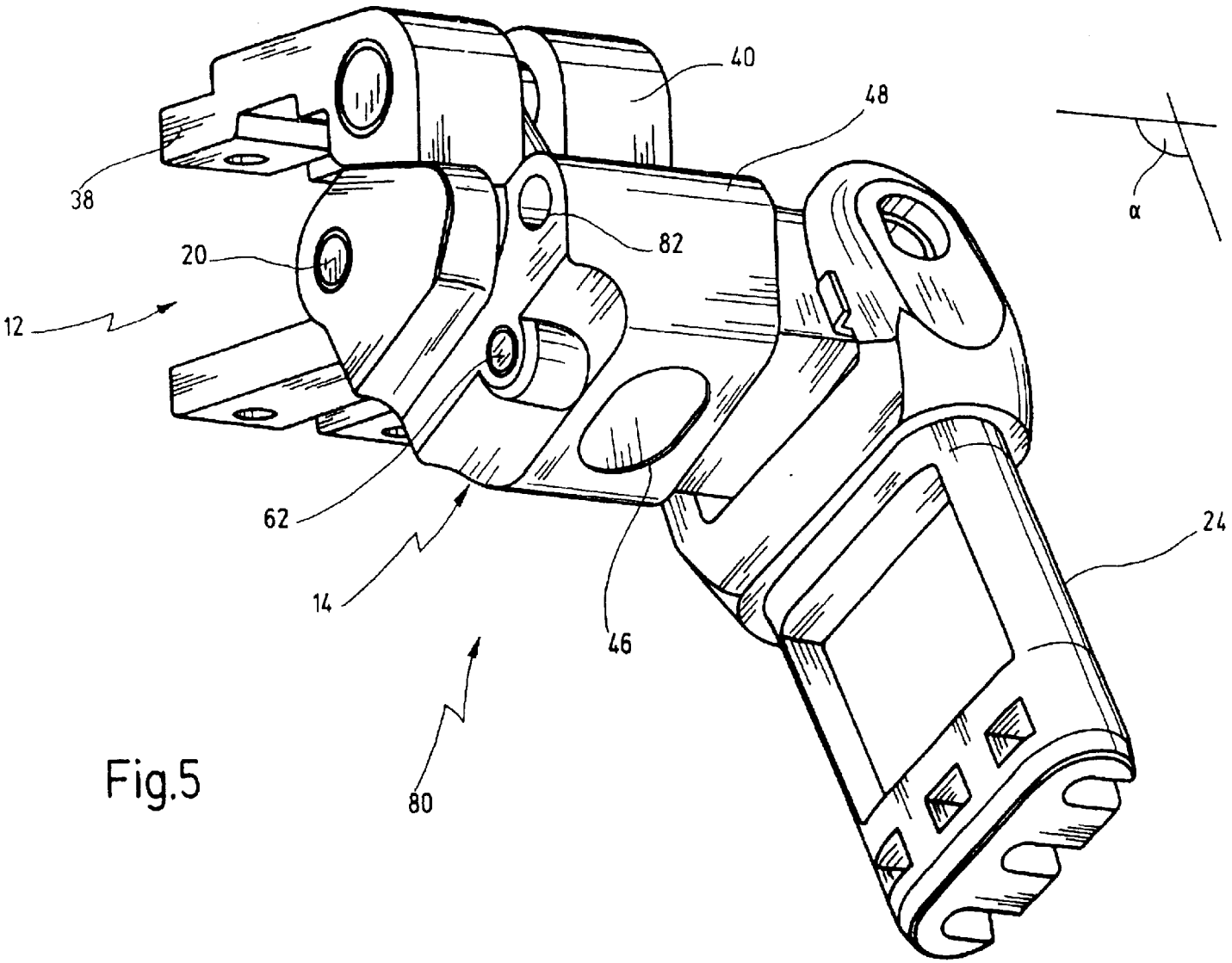
FIG. 5 shows the arm bearing of FIG. 1 used as a rigid arm bearing with adjustable tilting angle.
Figure 6:
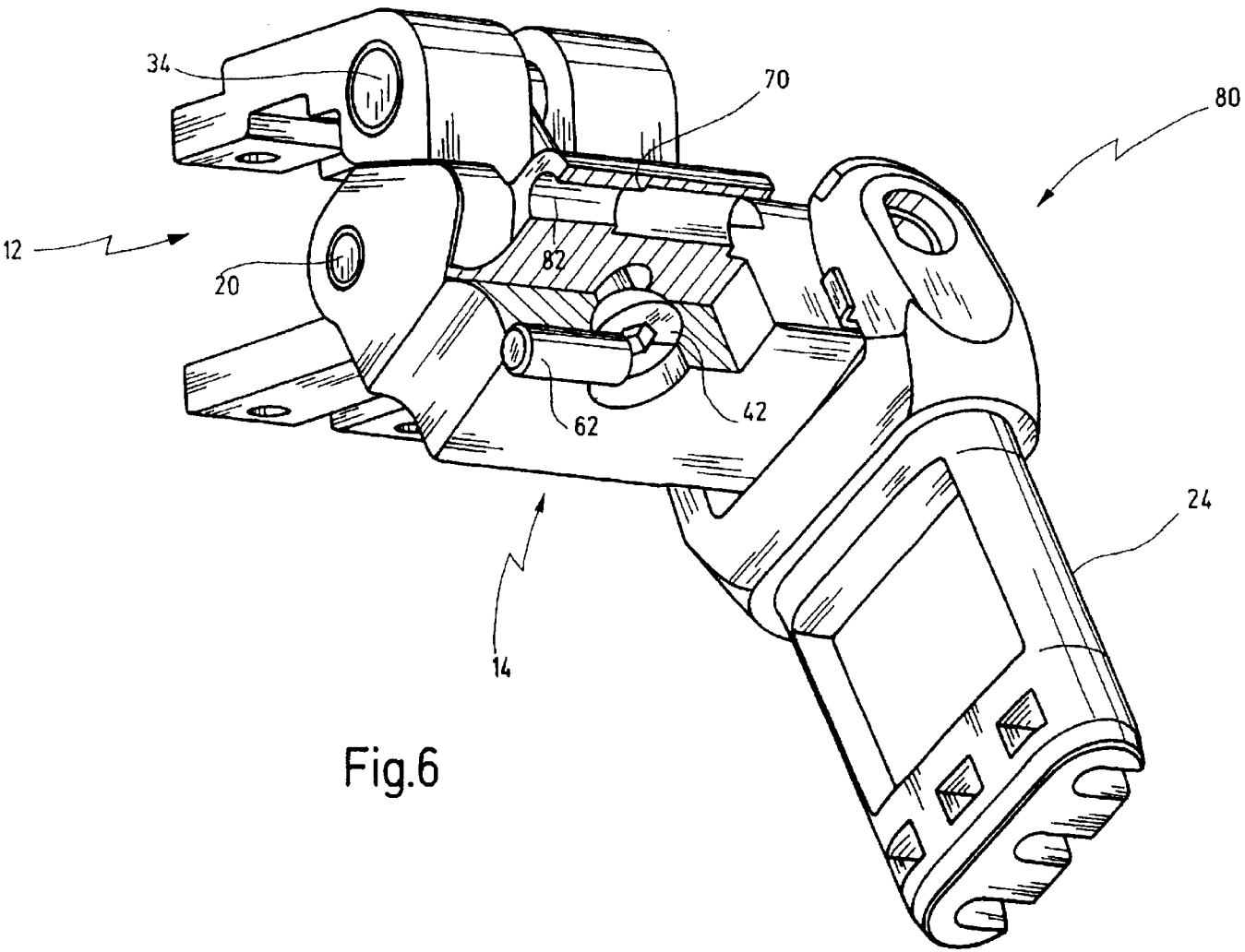
FIG. 6 shows the arm bearing of FIG. 5, again with part of the pillow block removed.

In FIGS. 5 and 6, a second embodiment of the arm bearing according to the invention is designated in its entirety by reference numeral 80.

The arm bearing 80 differs from the arm bearing 10 described before essentially by the fact that the connection element comprising the cross-member 64 and the push rod 66 is missing. The bore 82, in which the push rod 66 of the arm bearing 10 was guided, is therefore empty.

Given the fact that there is no operative connection between the link rod 24 and the locking slide 62, the head 42 of the threaded rod 30 will remain fixed on the stop 50, irrespective of the particular position of the link rod 24. The pillow block 14 therefore retains the adjusted tilting angle $\alpha$ irrespective of the position of the link rod 24. In the representation of FIGS. 5 and 6 the tilting angle $\alpha$ is equal to 60°.

The arm bearing 80, therefore, constitutes a rigid arm bearing whose tilting angle $\alpha$ can be adjusted using the threaded rod 30 by screwing the threaded rod 30 a greater or shorter length into the bolt 34.

Figure 7:
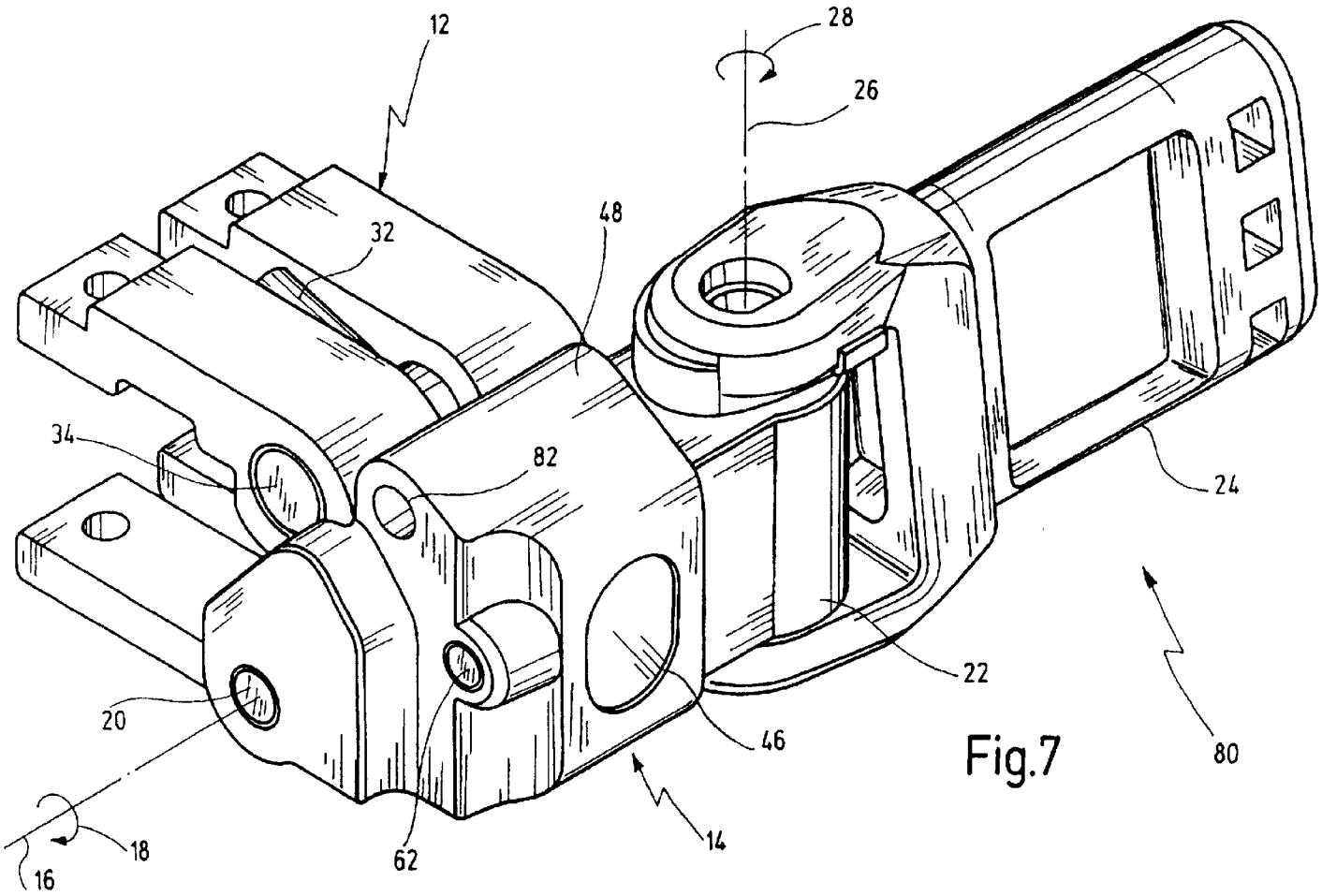
FIG. 7 shows the arm bearing according to FIG. 5, but with a firmly adjusted tilting angle of 0°.
Figure 8:
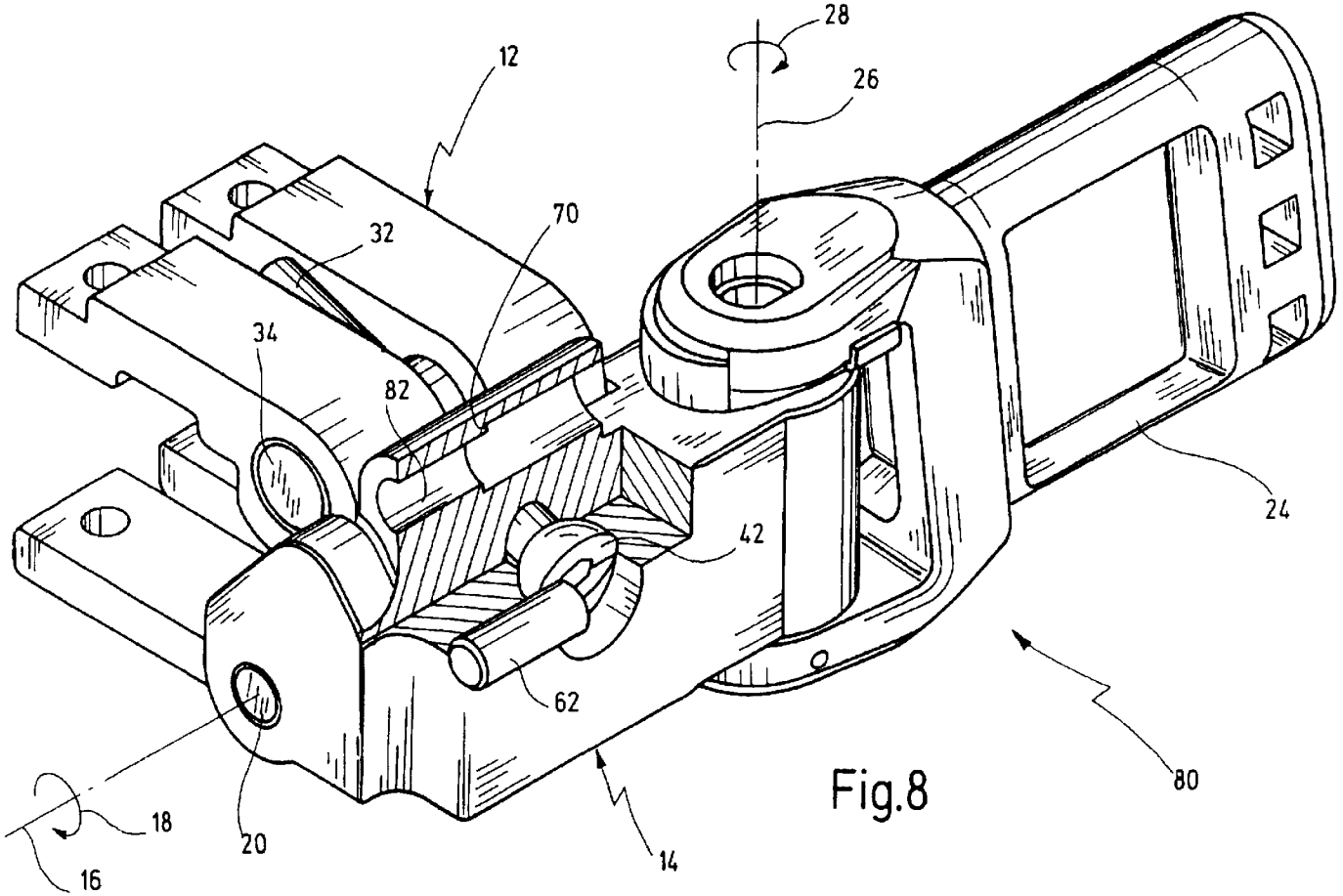
FIG. 8 shows the arm bearing of FIG. 7, again with part of the pillow block removed.

FIGS. 7 and 8 show the arm bearing 80 with a firmly adjusted tilting angle of $\alpha$=0°. Here again, the tilting angle $\alpha$ is independent of the rotary position of the link rod 24 due to the missing connection element.

Figure 9:
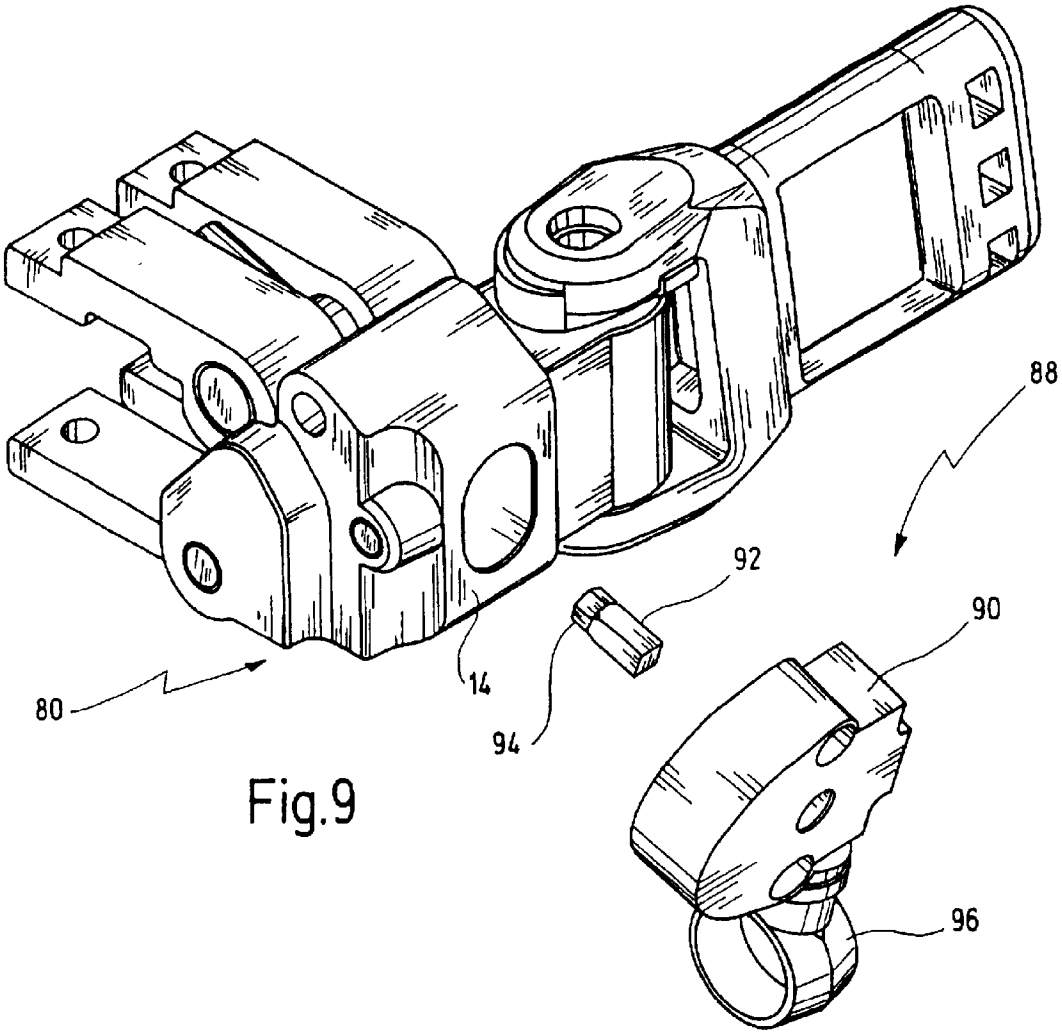
FIG. 9 shows a preferred embodiment for adjusting the maximum tilting angle and/or the desired rigid tilting angle of the arm bearing according to the invention.

FIG. 9 shows an especially preferred possibility of adjusting the tilting angle $\alpha$ of the arm bearings 10, 80. The solution consists of an adjusting device 88 in the form of a standard drive mechanism 90 known as such, which is connected with the threaded rod 30 via a coupling pin 92. The coupling pin 92 comprises a hexagon head 94 which corresponds exactly to the hexagon socket 44 of the head 42.

The standard drive mechanism 90 can be operated in the known way via its annular operating element 96 using a crank not shown in the drawing. It then transfers the rotary movement of the crank to the coupling pin 92 and, thus, to the threaded rod 30.

According to a further embodiment, a mounting plate carrying a cardan joint is arranged on the end face of the pillow block 14. One end of the cardan joint is equipped with a hexagon pin that can be fitted in the hexagon socket 44 of the threaded rod 30, while an operating element, such as the operating element 96, can be fitted on the other end for driving the cardan joint.

What is claimed is:

1. An arm bearing for an articulated-arm awning, comprising a pillow block, a bracket, said pillow block being hinged to said bracket for allowing to tilt said pillow block about a titling axis to a tilting angle, said pillow block being provided at one of its ends with at least one bearing eye for receiving an awning arm in a rotary fashion, said pillow block further comprising a threaded rod for adjusting said tilting angle, a first end of said threaded rod being received in a locating opening in said bracket such that the first end is substantially enclosed by said bracket, and a second end of said threaded rod being provided with a head resting against a stop on said pillow block in a given angular position of said pillow block;

a locking slide positionable with respect to said head of said threaded rod such that said threaded rod can be fixed on said stop in said given angular position in a locked configuration so as to secure the pillow block with respect to the bracket; and a spring arranged so as to bias the locking slide.

2. The arm bearing of claim 1, wherein said locking slide being movable in parallel to said tilting axis.

3. The arm bearing of claim 1, wherein said locking slide being arranged in said pillow block on a side of said threaded rod facing away from said bearing eye.

4. The arm bearing of claim 1, wherein said locking slide is designed as a bolt.

5. The arm bearing of claim 1, wherein said head of said threaded rod comprises a hexagon socket, and wherein said locking slide engages said head at a point spaced laterally from said hexagon socket.

6. The arm bearing of claim 1, wherein said bracket comprises two separate legs, with said threaded rod extending between said two separate legs.

7. The arm bearing of claim 1, wherein an adjusting device is provided for adjusting said threaded rod.

8. The arm bearing of claim 7, wherein said adjusting device is configured as a drive mechanism that can be attached to said threaded rod.

9. The arm bearing of claim 1, wherein said locking member is designed in that it comprises said locking slide only without comprising said connecting element for connecting to said awning arm, this design being used when said arm bearing is used as a rigid arm bearing with adjustable titling angle $\alpha$.

10. The arm bearing of claim 1, wherein the spring biases the locking slide in the locked configuration.

11. The arm bearing of claim 1, wherein the head of the threaded rod can be manipulated with the locking slide in the locked configuration so as to adjust the angular position of the pillow block.

12. The arm bearing of claim 1, wherein the locking slide is linearly movable and further comprising:

a link rod configured for attachment to the awning arm and defining an eccentric outer contour and a connecting element connected to the locking slide and in communication with the eccentric outer contour such that the connecting element translates a rotary movement of said awning arm to a linear movement of said locking slide so as to urge the locking slide to an unlocked configuration.

13. An arm-bearing for an articulated-arm awning comprising:

a pillow block defining at least a first passage and a second passage intersecting the first passage, a bracket pivotably attached about a tilting axis to the pillow block;

a bolt attached to the bracket and arranged generally parallel to the tilting axis and offset laterally therefrom with a transverse bore formed therein so as to define a seat;

a link rod pivotably attached about a rotary axis to the pillow block wherein the link rod is configured for attachment to an awning arm and wherein the link rod defines an eccentric outer contour;

a threaded rod extending through the first passage and with a first end threadedly engaged with the seat wherein the threaded rod comprises a head at the second end such that manipulation of the head induces the rod to rotate so as to move with respect to the seat so as to adjust an angular position of the arm-bearing; and a locking member comprising a locking slide extending through the second passage such that the locking slide engages a second end of the threaded rod so as to fix the bracket in the angular position about the tilting axis such that the arm bearing defines a rigid arm bearing wherein the pillow block defines a stop and wherein disengaging the locking slide from the threaded rod allows the bracket a range of motion through a tilting angle limited by engagement of the threaded rod with the stop wherein the locking member engages the eccentric outer contour such that rotation of the link rod about the rotary axis induces the locking slide to disengage from the threaded rod so as to permit the range of motion.

14. The arm bearing of claim 13, wherein the first passage intersects the second passage substantially perpendicularly.

15. The arm bearing of claim 13, wherein the head is accessible for adjustment when the locking slide is engaged with the second end of the threaded rod.

16. The arm bearing of claim 13, wherein adjusting the position of the threaded rod in the seat adjusts the range of motion of the bracket.

17. The arm bearing of claim 13, further comprising a third passage and wherein the locking member comprises:

a push rod positioned in the third passage, a cross-member interconnecting the push rod and the locking slide, and a spring arranged to urge the locking member to engage the locking slide with the threaded rod.

18. The arm bearing of claim 17, wherein the cross-member removably interconnects the push rod to the locking slide such that, when connected, the locking slide is in operative communication with the link rod such that rotation of the link rod about the rotary axis induces the locking slide to engage or disengage with the threaded rod and, when the push rod and the locking slide are not connected, the locking slide is decoupled from the rotation of the link rod.

19. The arm bearing of claim 18, wherein, when the cross-member interconnects the locking slide and push rod, the arm bearing comprises a tilting-joint arm bearing and, when the locking slide is not connected to the push rod, the arm bearing comprises a rigid arm bearing.

20. An arm-bearing for an articulated-arm awning comprising:

a pillow block defining at least a first passage, a second passage intersecting the first passage, and a stop;

a bracket pivotably attached about a tilting axis to the pillow block;

a bolt attached to the bracket and arranged generally parallel to the tilting axis and offset laterally therefrom with a transverse bore formed therein so as to define a seat;

a link rod pivotably attached about a rotary axis to the pillow block wherein the link rod is configured for attachment to an awning arm and defining an eccentric outer contour;

a threaded rod extending through the first passage and with a first end threadedly engaged with the seat wherein the threaded rod comprises a head at a second end such that manipulation of the head induces the threaded rod to rotate so as to move with respect to the seat; and a locking member comprising a locking slide extending through the second passage such that the locking slide is engagable with the second end of the threaded rod so as to fix the bracket in an angular position about the tilting axis and wherein the locking member engages the eccentric outer contour such that rotation of the link rod about the rotary axis induces the locking slide to disengage from the threaded rod so as to permit the bracket a range of motion through a tilting angle limited by engagement of the threaded rod with the stop.

21. The arm bearing of claim 20, wherein the first passage intersects the second passage substantially perpendicularly.

22. The arm bearing of claim 20, wherein the head is accessible for adjustment when the locking slide is engaged with the second end of the threaded rod so as to adjust the angular position.

23. The arm bearing of claim 20, wherein adjusting the position of the threaded rod in the seat adjusts the range of motion of the bracket.

24. The arm bearing of claim 20, further comprising a third passage and wherein the locking member comprises:

a push rod positioned in the third passage, a cross-member interconnecting the push rod and the locking slide, and a spring arranged to urge the locking member to engage the locking slide with the threaded rod.

25. The arm bearing of claim 24, wherein the cross-member removably interconnects the push rod to the locking slide such that, when connected, the locking slide is in operative communication with the link rod such that rotation of the link rod about the rotary axis induces the locking slide to engage or disengage with the threaded rod and, when the push rod and the locking slide are not connected, the locking slide is decoupled from the rotation of the link rod.

26. The arm bearing of claim 25, wherein, when the cross-member interconnects the locking slide and push rod, the arm bearing comprises a tilting-joint arm bearing and when the locking slide is not connected to the push rod, the arm bearing comprises a rigid arm bearing.

27. An arm bearing for an articulated-arm awning, comprising a pillow block;

a bracket;

the pillow block being hinged to the bracket allowing the pillow block to tilt about a titling axis to a tilting angle, the pillow block being provided at one of its ends with at least one bearing eye for receiving an awning arm in a rotary fashion, the pillow block further comprising a threaded rod for adjusting the tilting angle, a first end of the threaded rod being received in a locating opening in the bracket such that the first end is substantially enclosed by the bracket, and a second end of the threaded rod being provided with a head resting against a stop on the pillow block in a given angular position of the pillow block;

a locking slide positionable with respect to the head of the threaded rod such that the threaded rod can be fixed on the stop in the given angular position in a locked configuration so as to secure the pillow block with respect to the bracket wherein the head of the threaded rod comprises a hexagon socket, and wherein the locking slide engages the head at a point spaced laterally from the hexagon socket.

28. An arm bearing for an articulated-arm awning, comprising a pillow block;

a bracket;

the pillow block being hinged to the bracket allowing the pillow block to tilt about a titling axis to a tilting angle, the pillow block being provided at one of its ends with at least one bearing eye for receiving an awning arm in a rotary fashion, the pillow block further comprising a threaded rod for adjusting the tilting angle, a first end of the threaded rod being received in a locating opening in the bracket such that the first end is substantially enclosed by the bracket, and a second end of the threaded rod being provided with a head resting against a stop on the pillow block in a given angular position of the pillow block;

a locking slide positionable with respect to the head of the threaded rod such that the threaded rod can be fixed on the stop in the given angular position in a locked configuration so as to secure the pillow block with respect to the bracket wherein the locking slide is linearly movable and further comprises:

a link rod configured for attachment to the awning arm and defining an eccentric outer contour and a connecting element connected to the locking slide and in communication with the eccentric outer contour such that the connecting element translates a rotary movement of the awning arm to a linear movement of the locking slide so as to urge the locking slide to an unlocked configuration.

29. An arm-bearing for an articulated-arm awning comprising:

a pillow block defining at least a first passage, a second passage intersecting the first passage, and a third passage;

a bracket pivotably attached about a tilting axis to the pillow block;

a bolt attached to the bracket and arranged generally parallel to the tilting axis and offset laterally therefrom with a transverse bore formed therein so as to define a seat;

a link rod pivotably attached about a rotary axis to the pillow block wherein the link rod is configured for attachment to an awning arm;

a threaded rod extending through the first passage and with a first end threadedly engaged with the seat wherein the threaded rod comprises a head at the second end such that manipulation of the head induces the rod to rotate so as to move with respect to the seat so as to adjust an angular position of the arm-bearing; and a locking member comprising:

a locking slide extending through the second passage such that the locking slide engages a second end of the threaded rod so as to fix the bracket in the angular position about the tilting axis such that the arm bearing defines a rigid arm bearing wherein the pillow block defines a stop and wherein disengaging the locking slide from the threaded rod allows the bracket a range of motion through a tilting angle limited by engagement of the threaded rod with the stop;

a push rod positioned in the third passage;

a cross-member interconnecting the push rod and the locking slide; and a spring arranged to urge the locking member to engage the locking slide with the threaded rod.

30. An arm bearing for an articulated-arm awning, comprising:

a pillow block defining at least a first passage, a second passage intersecting the first passage, a third passage and a stop;

a bracket pivotably attached about a tilting axis to the pillow block;

a bolt attached to the bracket and arranged generally parallel to the tilting axis and offset laterally therefrom with a through-going transverse bore formed therein having an internal thread;

a threaded rod extending through the first passage of the pillow block and with a first end section threadedly engaged with the internal thread of the bolt, and with a head at a second end resting on the stop on said pillow block in a given angular position of the pillow block, wherein a manipulation of the head induces the threaded rod to move in an axial direction with respect to the threaded bolt;

said first end section of the threaded bolt being received in a locating opening in the bracket such that the first end section extending beyond the bolt is substantially enclosed by said bracket and the second end is substantially enclosed by said pillow block;

a locking member comprising a locking slide extending through the second passage such that the locking slide is engagable with the second end of the threaded rod so as to fix the bracket in an angular position about the tilting axis; and the third passage extending generally parallel to the second passage and configured to receive a push rod.

* * * * *